United States Patent [19]

Busch

[11] 3,954,054

[45] May 4, 1976

[54] SQUEEZE PRINTER FOR PAPERS OR STACKS OF PAPERS OF VARYING THICKNESSES

[75] Inventor: Richard E. Busch, La Puente, Calif.

[73] Assignee: Addmaster Corporation, San Gabriel, Calif.

[22] Filed: July 25, 1974

[21] Appl. No.: 491,872

[52] U.S. Cl. ..... 101/93.1 B; 101/93.22; 101/93.41; 101/110

[51] Int. Cl.[2] ..... B41J 1/22

[58] Field of Search ..... 197/49, 51, 144–149, 197/6.4; 101/110, 109, 91, 93.18, 93.35, 93.36, 93.41, 99, 95, 93.22, 93.31–93.32; 178/34, 35; 235/60.28

[56] References Cited

UNITED STATES PATENTS

| | | | |
|---|---|---|---|
| 2,616,366 | 11/1952 | Eickman | 101/93.36 X |
| 2,625,100 | 1/1953 | Williams et al. | 197/49 X |
| 3,307,673 | 3/1967 | Jackson | 197/6.4 |
| 3,418,933 | 12/1968 | Schaefer | 197/51 X |
| 3,461,797 | 8/1969 | Trab et al. | 101/91 X |
| 3,618,513 | 11/1971 | Merker | 101/109 X |
| 3,650,206 | 3/1972 | Seabury | 101/93.36 |
| 3,664,259 | 5/1972 | Weinkle | 101/99 |
| 3,712,211 | 1/1973 | Thut | 101/93.36 |
| 3,788,214 | 1/1974 | Folkens et al. | 101/95 X |
| 3,837,461 | 9/1974 | Waibel | 197/148 X |

OTHER PUBLICATIONS

Rogers, "Flexible Print Stick", IBM Tech. Discl. Bull., Vol. 3, No. 6, Nov. 1960.

*Primary Examiner*—Ralph T. Rader
*Attorney, Agent, or Firm*—Fred N. Schwend

[57] ABSTRACT

A squeeze printer for papers or stacks of papers of varying thicknesses wherein a plurality of printing platens are provided comprising individual flexible wall sections of a paper supporting chute which will accommodate different thicknesses of paper or stacks of paper. An actuator is effective through selectively disabled yieldable interposers to transfer a printing force through the platens to the paper.

6 Claims, 3 Drawing Figures

SQUEEZE PRINTER FOR PAPERS OR STACKS OF PAPERS OF VARYING THICKNESSES

BACKGROUND OF THE INVENTION

1. Field of the Invention

This invention relates to data printers and has particular reference to printers for printing on papers or stacks of papers, such as bank deposit slips, of varying thicknesses.

2. Description of the Prior Art

Certain types of printers, such as those used in banks, are required to print on stacks of paper slips or forms which vary appreciably in thickness. Printers employed heretofore for this purpose have generally been of the impact type wherein type hammers or type bearing members are spring impelled against the paper to effect an imprint. In such cases, the thickness of the slips or stack of slips have little effect on the quality of the printing impression on the outermost paper surface.

In cases where interleaved carbon papers are required to provide multiple copies it has been general practice to adjust the tension of the hammer impelling springs in accordance with such number of copies. That is, in those cases where a large number of superimposed copies are to be printed the spring tension is increased. This is normally effected as an adjustment prior to the printing operation.

Although impact printers of the above type are generally satisfactory, they are obviously noisy in operation.

Squeeze type printers, which are inherently quieter than impact printers, have also been used extensively heretofore. In such printers, a platen or type bearing member is forced, at a controlled rate of movement, against the paper to effect an imprint. Such printers must exert considerable pressure during imprinting operations and are generally operated by cams, toggles or levers which have a definite throw and therefore can not accommodate different thicknesses of paper or stacks of paper. Accordingly, the quality of impression varies considerably with the thickness of such papers or paper stacks.

Accordingly, the principal object of the present invention is to provide a data printer of the squeeze type capable of accommodating stacks of papers of different thicknesses to be printed.

Another object is to selectively disable printing in different denominational orders or groups of orders in a squeeze printer.

A further object is to provide a data printer of the above type which is simple, compact, reliable and economically manufactured.

SUMMARY OF THE INVENTION

According to the present invention, a paper guide or support in the form of a chute is provided having spaced side walls to support one or more slips of paper on edge. The walls are normally separated sufficiently to receive a maximum number of such slips.

A series of type members carrying type characters thereon are differentially settable adjacent an opening in one of the walls to locate selected type characters at a printing line. The other of such walls is formed of thin, hard material, such as metal, having a high degree of flexibility to form the printing platen.

Interposers having relatively soft elastomeric head portions are normally located between the flexible platen and a constant throw actuator.

During a printing operation, the actuator is advanced to drive the interponent and thus flex the flexible wall of the paper chute, to impress the slips or stacks of slips against the type characters located at the printing station.

Due to their compressible and flexible nature, the elastomeric head portions of the interposers will apply substantially even printing pressure to stacks of slips of different thicknesses, even though the throw of the actuator is constant. Also, the elastomeric material permits greater tolerances or accuracies in the heighths of different type characters while resulting in even printing impressions along a line of print. On the other hand, the thin, relatively hard, flexible wall of the paper guide not only supports the slips but insures a clear, crisp impression against the type characters. That is, the hard, flexible wall resists compound bending, i.e., concurrent bending about intersecting axes, and this resists deformation into the interstices between adjacent or opposite character lands in each type character.

BRIEF DESCRIPTION OF THE DRAWINGS

The manner in which the above and other objects of the invention are accomplished will be readily understood on reference to the following specification when read in conjunction with the accompanying drawing, wherein.

DESCRIPTION OF THE PREFERRED EMBODIMENT

Figure 2:
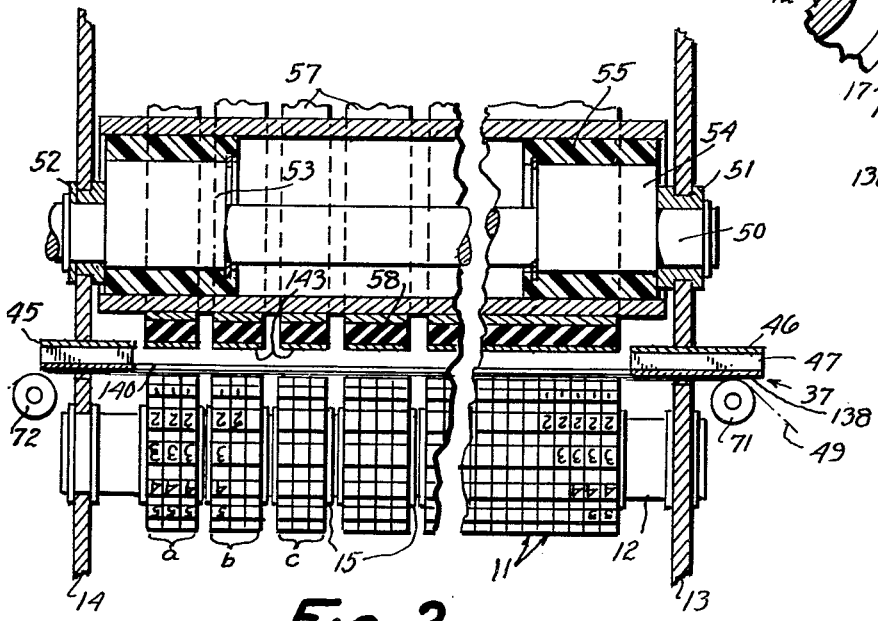
FIG. 2 is a sectional plan view taken substantially along the line 2—2 of FIG. 1.

Referring to the drawings, the printer comprises a plurality of type wheels 11 arranged side-by-side in groups, i.e., *a*, *b* and *c* in FIG. 2 and rotatably mounted independent of each other on a stationary hollow shaft 12 supported by spaced printer side frames 13 and 14. The groups of type wheels 11 are separated by suitable clips 15 secured in grooves (not shown) in shaft 12.

Each type wheel 11 has a series of type characters 16 equally spaced therearound and interspersed with gear tooth spaces 17 which mesh with gear teeth 19 formed on an aligned actuator sector 18, preferably of plastic.

The sectors 18 are independently rotatably mounted on a rockshaft 20 and have openings 21 therein through which a bail rod 22 extends. The rod 22 is supported by spaced arms, one of which is shown at 23, secured to the rockshaft 20. The bail rod normally frictionally engages depressions 24 formed in yieldable tails 25 formed integrally with the sectors 18.

During the first half of a printer cycle, the shaft 20 is rocked clockwise causing the bail rod 22 to yieldably drive the various sectors 18 in the same direction. After a printing impression, as will be described later, the bail rod 22 is returned counterclockwise to thereby return the various sectors 18 and type wheels 11 to their illustrated home positions.

Means are provided to selectively arrest different type sectors so as to present selected type characters 16 at a printing line or station 26. For this purpose, a stop pawl 27 is provided for each sector 18. The pawls 27 are independently pivoted on a stationary rod 28 and are adapted to engage any of a plurality of spaced stop teeth 30 on the sectors.

The pawls 27 are moved into blocking relation with certain of the stop teeth 30 by electromagnetic coils 38, each of which surrounds one leg of a U-shaped magnet core 40. Upon energization of a coil 38, an iron armature 41, pivoted at 42 is attracted upwardly and in doing so forces a rod 43 endwise to engage and rock the associated pawl 27 into blocking engagement with whichever sector stop tooth 30 is next adjacent the pawl at the time the latter is actuated.

A paper tape 31 is fed from the suitable supply roll, over guide roller 32, through a guide chute 33 and between a feed roller 34 and a pressure roller 35. Thereafter, the paper is quided upwardly past a guide member 36 and through a paper receptacle generally indicated at 37. The latter comprises a forward wall 138 having an opening 140 therein directly behind the type wheels 11, and a relatively flexible rear wall 141. The latter is suitably secured at its lower end to a stationary cross brace 142 suitably supported by side frames 13 and 14 and is divided adjacent the brace 142 into a plurality of upwardly extending flexible fingers or wall sections, i.e., 143 (FIG. 2), each section having a width equal to the width of an opposing group of type wheels 11. The wall sections form individual printing platens.

Figure 1:
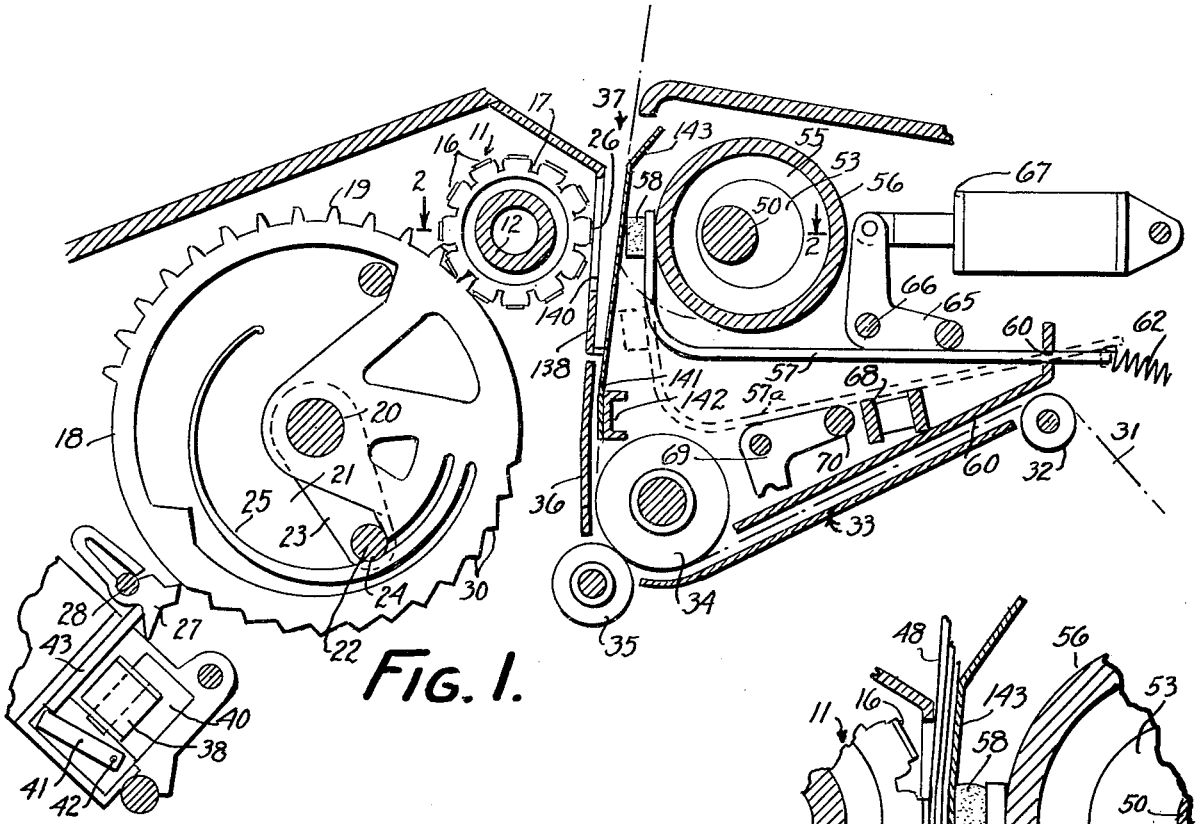
FIG. 1 is a sectional view through a data printer embodying a preferred form of the present invention.
Figure 3:
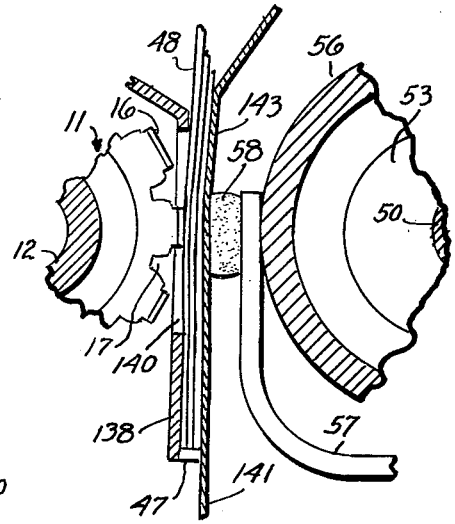
FIG. 3 is an enlarged fragmentary sectional view illustrating a stack of slips in the process of being printed.

Outboard sections 45 and 46 of the paper receptacle 37 are fitted in suitable openings in the side frames 13 and 14 and have bottom ledges 47 which can support a stack 48 (FIG. 3) of paper slips, cards or the like of varying thickness on edge in front of the tape 31.

An inked printing ribbon 49 is guided over rollers 71 and 72 and extends across the opening 140 in wall 138. Obviously, if the paper is coated with a pressure sensitive color responsive coating, the ribbon 49 can be eliminated.

A printer shaft 50 is rotatably mounted in bearings 51 and 52 carried by the side frames 13 and 14, respectively, and is suitably rotated one revolution during the printing phase of each printer cycle. Shaft 50 carries two spaced eccentrics 53 and 54 on which are freely pivoted bearing sleeves 55 secured within the opposite ends of a hollow actuating roll 56.

A plurality of printing interposers 57 are provided for the different groups of type wheels 11 and each has a head 58 of elastomeric material suitably bonded thereto and normally lying directly behind a respective one of the flexible wall sections or platens 143.

The interposers 57 are guided for both endwise and rocking movement in guide slots 60 formed in the upper member 60 of the tape guide chute 33. A spring 62 is tensioned between the rear end of each interposer 57 and a suitable part of the frame (not shown) to normally hold the interposer in position intermediate the respective flexible platen 143 and the actuator roll 56.

During the printing phase of each cycle, and when the eccentrics 53 and 54 are moved toward the forward limits of their throws, the actuator roller 56 forces the interposers 57 forwardly, causing the heads 58 to deflect the platens 143 to engage the tape 31 and slip or slips 48 to yieldably force the same into printing impact against the various type characters 16 located at the printing line.

Due to the compressible and flexible nature of the heads 58, stacks of slips 48 of different thicknesses can be equally well impressed against the type characters, although the printing impression may be somewhat heavier when a relatively large number of slips 48 are located in the receptacle 37 than when just one or two or no slips 48 are located therein. However, due to the thin, hard surfaces of the platens 143, clear, crisp printing impressions are obtained in all cases. This would not be possible if the heads 58 were to directly engage the paper tape 31 since the soft material of such heads would tend to deform into the interstices between the type character lands of each type character under the pressure applied to it by the actuator roll 56 and thus result in fuzzy or smudged printed characters.

The slips 48 may or may not have interleaved carbons between them, depending on whether it is desired to print on all slips or just the foremost one.

In practice it has been found that when using a head 58 of elastomeric material having a thickness on the order of 0.100 inches and a hardness factor on the order of 50 Shore, as measured on a standard Shore Durometer, acceptable printing impressions are obtainable on stacks of slips which may vary from 0.001 inches to 0.012 inches in thickness.

Means are provided to selectively disable printing from selected groups of type wheels 11. For this purpose, levers 65 are located above respective ones of the interposers 57, the levers being independently pivoted on a support rod 66 and pivotally connected to individual solenoids 67. Upon energization of a solenoid, its lever 65 will rock the associated interposer 57 downwardly into its dotted line position 57*a* where it will be held by a permanent magnet 68 with its head 58 located out of a position intermediate its respective platen 143 and the actuator roll 56. Thus, during the ensuing printing phase, such platen 143 will not be actuated to cause an imprint.

During the latter part of a printing cycle, a bail rod 70 extending below all of the interposers 57 will be raised by means including arms 69 to return any of the interposers 57 which have been previously lowered to their illustrated positions.

In those applications where the variations in thickness of different stacks of paper to be printed are beyond that which can be properly printed by the action of the eccentrics 53, 54 and actuator roll 56, a variable throw actuator such as that disclosed and claimed in the copending application of R. E. Busch, Ser. No. 491,871 filed July 25, 1974 and entitled "Squeeze Printer For Papers Or Stacks Of Papers Of Varying Thicknesses", may be substituted.

I claim:

1. A data printer comprising type members, type characters on said members, means for differentially setting said type members to position different ones of said type characters at a printing station, a thin, hard printing platen of resiliently bendable (flexible) material, means fixedly supporting said platen adjacent one end, the other end of said platen being free, a portion of said platen adjacent said other end facing said type characters at said printing station, said platen forming a guide wall for a record medium, actuating means for flexing said platen to press said other end portion toward said type characters and thereby impress said record medium against said type characters at said printing station said actuating means comprising an actuator and an interposer, said interposer being interposable in a location between said actuator and said platen and means for selectively moving said interposer in and out of said interposed location.

2. A data printer as defined in claim 1 wherein said actuating means includes a body of yieldable material engaging said platen on the side thereof opposite said type characters at said printing station.

3. A data printer as defined in claim 1 provided with a plurality of said platens, corresponding plurality of said type members and an actuating means for each of said platens, each of said actuating means including an interposer positioned between said platen and a driving member, each interposer being mounted for selective removal from said position to disable its associated platen.

4. A data printer comprising type members, type characters on said members, means for differentially setting said type members to position different ones of said type characters at a printing station, means for supporting a record medium adjacent said printing station, a thin, hard printing platen of flexible material, means swingably supporting said platen adjacent one end thereof with a portion adjacent its other end facing said type characters at said printing station, said other end of said platen being free to swing, said platen forming a guide wall for said record medium, and means comprising actuating means for swinging said platen about said one end to press said other end portion toward said type characters and thereby to impress said record medium against said type characters at said printing station, said actuating means comprising an actuator and an interposer, said interposer being interposable in a location between said actuator and said platen, and means for selectively moving said interposer in and out of said interposed location.

5. A data printer comprising type members, type characters on said members, means for differentially setting said type members to position different ones of said type characters at a printing station, a paper receptacle for supporting one or more papers adjacent said printing station, said receptacle comprising a first paper guide wall having an opening there adjacent said type characters at said printing station, and a second paper guide wall spaced from said first guide wall, said second guide wall comprising a plurality of platen sections of hard, flexible material arranged in side-by-side relation, and means comprising an actuating member for deflecting said platen sections to impress said record medium against said type characters at said printing station and interposers intermediate respective ones of said platen sections and said actuating member, said interposers comprising members of flexible material.

6. A data printer as defined in claim 5 comprising means for selectively moving certain of said interposers into and out of the path of said actuator.

* * * * *